US005651662A

United States Patent [19]

Lee et al.

[11] Patent Number: 5,651,662

[45] Date of Patent: Jul. 29, 1997

[54] FILM COOLED WALL

[75] Inventors: Ching-Pang Lee; Ronald Scott Bunker, both of Cincinnati, Ohio; Nesim Abuaf, Schenectady, N.Y.

[73] Assignee: General Electric Company, Cincinnati, Ohio

[21] Appl. No.: 968,544

[22] Filed: Oct. 29, 1992

[51] Int. Cl.[6] ..... F01D 5/18

[52] U.S. Cl. ..... 416/97 R; 60/755; 60/757; 416/95

[58] Field of Search ..... 60/752, 754, 755, 60/756, 757; 416/95 R, 97 R, 96 R, 95

[56] References Cited

U.S. PATENT DOCUMENTS

| | | | |
|---|---|---|---|
| 3,515,499 | 6/1970 | Beer et al. | 416/95 |
| 3,542,486 | 11/1970 | Kercher et al. | 416/90 |
| 3,845,620 | 11/1974 | Kenworthy | 60/39.65 |
| 4,653,983 | 3/1987 | Vehr | 416/97 R |
| 4,664,597 | 5/1987 | Auxier et al. | 416/97 R |
| 4,738,588 | 4/1988 | Field | 416/97 R |
| 4,770,608 | 9/1988 | Anderson et al. | 416/97 R |
| 4,827,587 | 5/1989 | Hall et al. | 29/156 B |
| 4,859,147 | 8/1989 | Hall et al. | 416/97 R |
| 5,062,768 | 11/1991 | Marriage | 416/97 R |
| 5,223,320 | 6/1993 | Richardson | 428/137 |
| 5,326,224 | 7/1994 | Lee et al. | 416/97 R |
| 5,435,139 | 7/1995 | Pidcock et al. | 60/757 |
| 5,464,322 | 11/1995 | Cunha et al. | 415/115 |

*Primary Examiner*—Michael J. Carone
*Assistant Examiner*—Christopher K. Montgomery
*Attorney, Agent, or Firm*—Andrew C. Hess; Patrick R. Scanlon

[57] ABSTRACT

A wall adapted for use in a gas turbine engine between a first and a hotter second fluid includes a first side over which is flowable the first fluid, and an opposite second side over which is flowable the second fluid. An elongate slot extends inwardly from the second side and is disposed in flow communication with a plurality of longitudinally spaced apart holes extending inwardly from the first side. The holes are disposed at a compound angle relative to the second side for discharging the first fluid obliquely into the slot and at a shallow discharge angle from the slot along the second side. In a preferred embodiment, the slot has an aft surface including a plurality of longitudinally spaced apart grooves extending from the holes to the wall second side.

10 Claims, 3 Drawing Sheets

FILM COOLED WALL

The present invention relates generally to gas turbine engines, and, more specifically, to film cooling of walls therein such as those found in rotor blades, stator vanes, combustion liners and exhaust nozzles, for example.

BACKGROUND OF THE INVENTION

Gas turbine engines include a compressor for compressing ambient airflow which is then mixed with fuel in a combustor and ignited for generating hot combustion gases which flow downstream over rotor blades, stator vanes, and out an exhaust nozzle, These components over which flows the hot combustion gases must, therefore, be suitably cooled to provide a suitable useful life thereof, which cooling uses a portion of the compressed air itself bled from the compressor.

For example, a rotor blade or stator vane includes a hollow airfoil the outside of which is in contact with the combustion gases, and the inside of which is provided with cooling air for cooling the airfoil. Film cooling holes are typically provided through the wall of the airfoil for channeling the cooling air through the wall for discharge to the outside of the airfoil at a shallow angle relative to the flow direction of the combustion gases thereover to form a film cooling layer of air to protect the airfoil from the hot combustion gases and for cooling the airfoil. In order to prevent the combustion gases from flowing backwardly into the airfoil through the film holes, the pressure of the cooling air inside the airfoil is maintained at a greater level than the pressure of the combustion gases outside the airfoil to ensure only forward flow of the cooling air through the film holes and not backflow of the combustion gases therein. The ratio of the pressure inside the airfoil to outside the airfoil is conventionally known as the backflow margin which is suitably greater than 1.0 for preventing backflow.

The ratio of the product of the density and velocity of the film cooling air discharged through the film holes relative to the product of the density and velocity of the combustion gases into which the film cooling air is discharged is conventionally known as the film blowing ratio. The film blowing ratio, or mass flux ratio, of the injected film cooling air to the combustion gas flow is a common indicator for the effectiveness of film attachment. Values of the film blowing ratio greater than about 0.7 to 1.5, for example, indicate the tendency for the film cooling air to lift off the surface of the airfoil near the exit of the film cooling hole, which is conventionally known as blow-off. Effective film cooling requires that the film cooling air be injected in a manner which allows the cooling air to adhere to the airfoil outside surface, with as little mixing as possible with the hotter combustion gases. One conventionally known method to aid in obtaining effective film cooling is to inject the cooling air at a shallow angle relative to the outside surface. The blow-off of film cooling air increases mixing with the hotter gases to varying extents, depending upon the severity of the blow-off. This results in a decrease in the effectiveness of the film cooling air and, therefore, decreases the performance efficiency of the cooling air which, in turn, reduces the overall efficiency of the gas turbine engine.

Another common indicator of film effectiveness is the film coverage. The coverage is generally known as the fractional amount of the airfoil outside surface which is thought to have film injected over it, at the exit of a row of film cooling holes. An increased coverage generally, but not necessarily, means an increased film effectiveness. The maximum coverage which may be obtained for a single configuration of film cooling is 1.0.

In order to reduce the film blowing ratio, it is known to provide tapered film cooling holes which reduce the velocity of the film cooling air as it flows therethrough by the conventionally known diffusion process for improving the effectiveness of the film cooling air discharged from the hole. It is also conventionally known to provide a longitudinally extending slot in the airfoil wall which is disposed perpendicularly relative to the direction of the combustion gases, with the slot being fed by a plurality of longitudinally spaced apart film cooling metering holes. The slot provides a plenum of increased area relative to the collective area of the metering holes which, therefore, reduces the velocity of the film cooling air therein by diffusion prior to discharge from the slot along the wall outer surface. In addition, the provision of a slot and the effective diffusion of cooling air within this slot serves to increase the film coverage as the cooling air exits onto the airfoil outside surface.

It is also recognized that the holes-slot film cooling arrangement has varying degrees of effectiveness depending upon the particular configuration thereof, and improvements thereof are desired.

SUMMARY OF THE INVENTION

A wall adapted for use in a gas turbine engine between a first and a hotter second fluid includes a first side over which is flowable the first fluid, and an opposite second side over which is flowable the second fluid. An elongate slot extends inwardly from the second side and is disposed in flow communication with a plurality of longitudinally spaced apart holes extending inwardly from the first side. The holes are disposed at a compound angle relative to the second side for discharging the first fluid obliquely into the slot and at a shallow discharge angle from the slot along the second side. In a preferred embodiment, the slot has an aft surface including a plurality of longitudinally spaced apart grooves extending from the holes to the wall second side.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
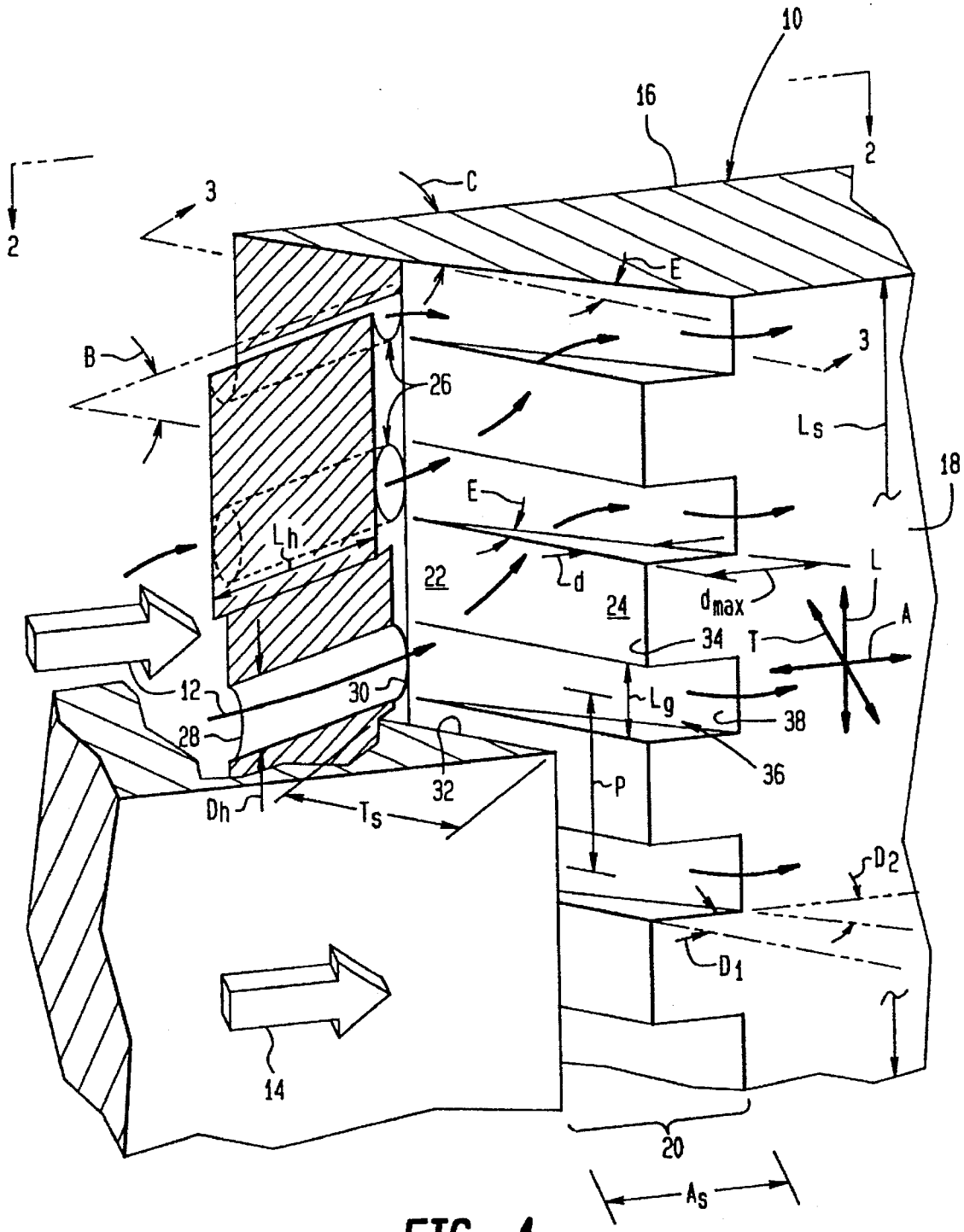
FIG. 1 is a schematic, partly sectional perspective view of an exemplary wall having a slot disposed in flow communication with a plurality of holes for providing film cooling.

Illustrated schematically in FIG. 1 is a wall 10 adaptable for use in a gas turbine engine (not shown) between a first, or relatively cold, fluid 12 and a second, or relatively hot, fluid 14, which is hotter than the first fluid 12. In the application of a gas turbine engine, the first fluid 12 will typically be a portion of compressed air bled from the compressor of the gas turbine engine, and the second fluid 14 will be the hot combustion gases generated in the combustor thereof.

The wall 10 includes a first side, or inner surface, 16 configured for facing the first fluid 12, and over which is flowable the first fluid 12. The wall 10 also includes an opposite, second side, or outer surface, 18 which is configured for facing the second fluid 14 and over which is flowable the second fluid 14 in a downstream direction thereover. The downstream direction is defined herein as an axial axis A relative to the second side 18 for indicating the predominant direction of flow of the second fluid 14 over the second side 18. The second side 18 is spaced from the first side 16 along a transverse axis T which is disposed perpendicularly to the axial A-axis.

The wall 10 further includes an elongate slot 20 extending partly inwardly along the transverse T-axis from the second side 18 toward the first side 16 and longitudinally along a longitudinal axis L disposed perpendicularly to both the transverse T-axis and the axial A-axis. The slot 20 has a transverse width $T_s$, axial width $A_s$. and longitudinal length $L_s$ which are conventionally determined for each design application. The slot 20 also has a longitudinally extending inlet 22 at one transverse end thereof and a longitudinally extending outlet 24 at an opposite end thereof at the second side 18.

The wall 10 further includes a plurality of longitudinally spaced apart metering holes 26 extending partly inwardly from the first side 16 toward the second side 18, and disposed in flow communication with the slot 20 for channeling thereto the first fluid 12. In this exemplary embodiment, the holes 26 are cylindrical and have a diameter $D_h$ and a length $L_h$ which are conventionally selected for each design application for channeling the first fluid 12 into the slot 20. Each hole 26 includes an inlet 28 on the first side 16, and an outlet 30 at its opposite end for discharging the first fluid 12 into the slot inlet 22.

Figure 2:
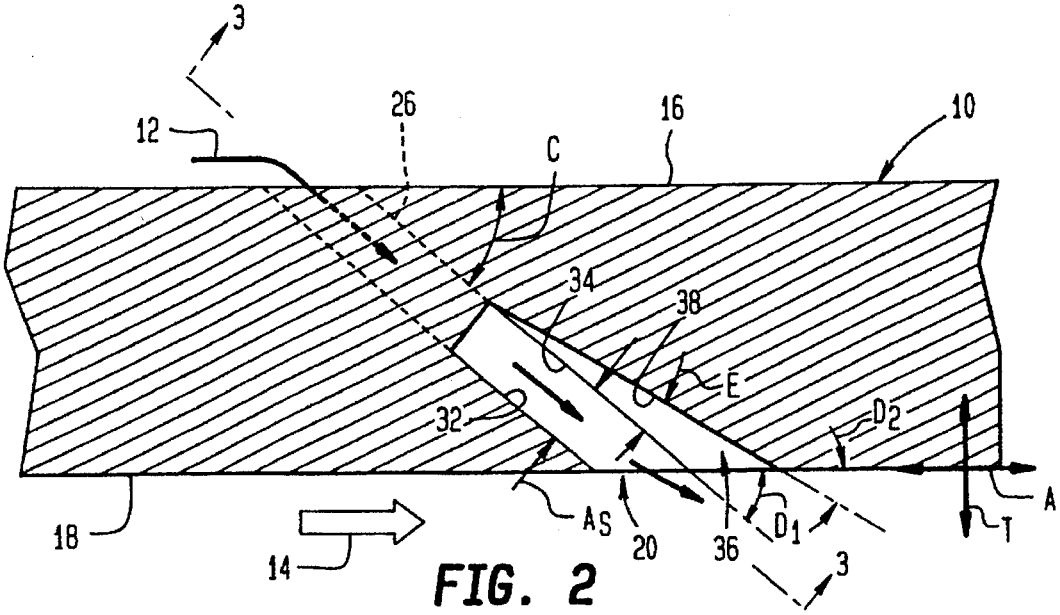
FIG. 2 is a transverse sectional view of the wall illustrated in FIG. 1 taken along line 2—2.
Figure 3:
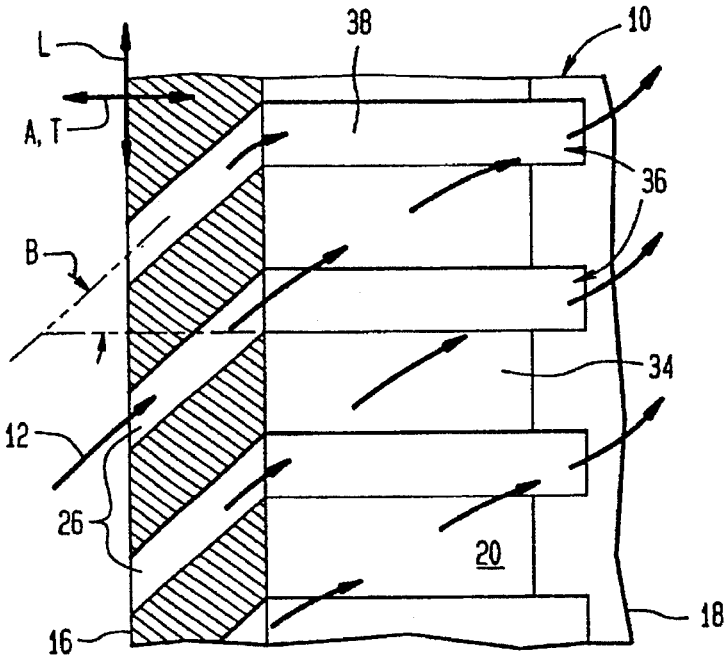
FIG. 3 is a longitudinal sectional view of the wall illustrated in FIGS. 1 and 2 taken along line 3—3.

In accordance with one embodiment of the present invention and as shown in FIGS. 1–3, each of the holes 26 is inclined at a compound angle relative to the axial A-axis both vertically in a plane containing the L-axis, and horizontally in a plane containing the A- and T-axes for improving the film cooling effectiveness of the slot 20 and holes 26 combination. More specifically, the centerline of each hole 26 is inclined in one direction at an acute angle B relative to the axial A-axis (see FIG. 3) in the longitudinal plane extending upwardly through the center of the slot 20 for discharging the first fluid 12 obliquely into the slot 20 instead of solely axially therethrough for increasing the flowpath of travel of the first fluid 12 therein which, in turn, increases pressure losses therein for reducing velocity thereof and reducing the film blowing ratio of the first fluid 12 relative to the second fluid 14. Since the compound angle of the holes 26 discharges the first fluid 12 obliquely, i.e., at the angle B, into the slot 20, the first fluid 12 is more evenly spread within the slot 20 and, therefore, allows fewer hales 26 to be used as compared to solely axially inclined holes in the horizontal plane without inclination in the vertical plane. The second portion of the compound angle inclination of the holes 26 is an acute angle C relative to the axial A-axis in the horizontal plane containing both the A-axis and the T-axis (see FIG. 2) for discharging the first fluid 12 into the slot 20 for discharge therefrom at an acute, or shallow, first discharge angle $D_1$ from the slot 20 along the second side 18 into the second fluid 14 for film cooling the second side 18.

The compound angles B and C of the holes 26 are shown in more particularity in FIGS. 2 and 3 wherein FIG. 2 is a section of the wall 10 in the horizontal plane containing both the A and T axes, and FIG. 3 is a section of the wall 10 in a longitudinal plane containing the L-axis. The holes 26 are inclined relative to both the L-axis (i.e. 90°-B) and the A-axis (i.e. angle C) so that the first fluid 12 is channeled through the holes 26 for discharge from the slot 20 at the shallow first discharge angle $D_1$ relative to the A-axis and the wall second side 18. In this preferred embodiment, the slot 20, as best shown in FIG. 2, is generally coextensive with the holes 26 and is nominally inclined at the first discharge angle $D_1$, with the first discharge angle $D_1$ being equal to the inclination angle C of the holes 26. The wall first and second sides 16, 18 are generally parallel to each other in this exemplary embodiment and may be straight, as shown, or curved to match the particular design application.

Referring again to FIG. 1, the slot 20 is defined by a preferably flat, forward, or upstream, surface 32 and an aft, or downstream, surface 34 spaced axially downstream therefrom and substantially parallel thereto. As shown in FIG. 2, the slot forward and aft surfaces 32, 34 are also preferably parallel and coextensive with the opposing surfaces defining the holes 26 and provide a generally constant flowpath width, i.e. the axial width $A_s$ of the slot 20. In this way, the slot 20 allows diffusion of the first fluid 12 along the longitudinal L-axis as it is discharged from the holes 26.

In order to add additional diffusion in another plane besides the longitudinal plane to further reduce the velocity of the first fluid 12, the slot aft surface 34 includes a plurality of longitudinally spaced apart grooves 86 as shown in FIGS. 1–3 which extend from the holes 26 all the way to the wall second side 18. As shown in FIG. 2, the slot aft surface 34 is disposed at the acute first discharge angle $D_1$ relative to the A-axis and the wall second side 18 at the slot 20, and each of the grooves 36 has a preferably flat base 38 disposed at an acute second discharge angle $D_2$ relative to the A-axis and the wall second side 18, with the second discharge angle $D_2$ being shallower, or less than, the first discharge angle $D_1$. In this way, as the first fluid 12 flows from the holes 26 it is not only diffused along the longitudinal L-axis but additional diffusion occurs due to the added grooves 36 which provide increased flow area relative to the slot aft surface 34.

As shown in FIG. 3, the grooves 36 are preferably disposed parallel to each other and perpendicularly to the slot longitudinal L-axis, or in the plane containing both the axial A-axis and transverse T-axis. The grooves 36 are, therefore, also disposed obliquely to the centerlines of the holes 26 at the acute angle B so that the holes 26 direct the first fluid 12 obliquely to the grooves 36. In this way, the longitudinally spaced apart grooves 36 disposed between the higher portions of the aft surface 34 therebetween create a turbulator effect to help trip and break up the discrete jets from the several holes 26 for creating turbulence inside the slot 20. This improves heat transfer therein as well as provides pressure losses in the first fluid 12 flowing through the slot 20 which further reduces the velocity thereof while promoting mixing of the several discrete jets of the first fluid 12 discharged from the holes 26 for obtaining a more uniform and continuous flow of the first fluid 12 from the slot outlet 24 to improve film cooling effectiveness of the first fluid 12 as it is discharged along the wall second side 18. Furthermore, the grooves 36 also help entrain the obliquely discharged first fluid 12 from the holes 26, and bend or turn this flow from the oblique direction, i.e. angle B in FIG. 3, to the axial direction along the axial A-axis for discharge substantially parallel with the flow of the second fluid 14 over the wall second side 18. Portions of the first fluid 12 are, therefore, redirected from the compound angle holes 26 to flow generally axially from the slot 20 within the grooves 36. This redirection or bending of the first fluid 12 causes an additional pressure loss therein which additionally reduces the velocity thereof for further reducing the film blowing ratio.

As shown in FIGS. 1 and 2, the grooves 36 preferably taper in depth d from a zero value adjacent to the outlets 30 of the holes 26 to a maximum value $d_{max}$ at the wall second side 18 at the slot outlet 24. The groove base 38 is preferably flat and inclined relative to the preferably flat, slot aft surface 34 at an acute angle E which may be up to about 10°–20°. In this way, the first fluid 12 is allowed to discharge from the hole outlet 30 initially obliquely to the grooves 36, at the acute angle B, inside the slot 20 for spreading the first fluid 12 therein, and then the tapering grooves 36 provide an increasing level of tripping and entrainment of the first fluid 12 as the first fluid 12 flows from the slot inlet 22 to the slot outlet 24. The first fluid 12 is, therefore, spread longitudinally within the slot 20, mixed together therein while experiencing pressure losses for reducing velocity thereof, and is then entrained for redirection axially in part through the grooves 36 for discharge from the slot outlet 24 in a nominally axial direction generally parallel to the axial A-axis to provide a more effective film cooling layer of the first fluid 12 between the wall second side 18 and the second fluid 14, and with a reduced film blowing ratio.

As shown in FIG. 1, the grooves 36 are preferably generally square in transverse section and may be suitably cast-in upon manufacture of the wall 10, or may be machined therein by conventional techniques, including laser cutting, as the slot 20 is formed. The holes 26 may be suitably formed in the wall 10 by conventional laser drilling after formation of the slot 20 and the grooves 36.

Figure 4:
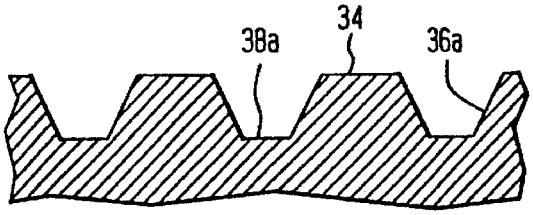
FIG. 4 is a sectional view of grooves in an aft wall of the wall slot in accordance with a second embodiment of the present invention.

In an alternate embodiment as shown in transverse section in FIG. 4, the grooves, designated 36*a* may be generally V-shaped in transverse section with a flat base 38*a*, or may come together at a point.

As shown in FIG. 1, the longitudinal width of each groove 36, designated $L_g$ may be relatively large and generally equal with its maximum depth $D_{max}$, and, for example, may be about the same size as the diameter $D_h$ of the holes 26. The pitch P or longitudinal spacing between the centers of the grooves 36 may be selected along with their width $L_g$ and maximum depth $d_{max}$ for each design application, with the pitch P being equal to or different than the pitch of the holes 26 as desired. And, the grooves 36 may be aligned with or offset from the hole outlets 30 also as desired. Of course, in each design application, the particular angles and dimensions described above may be obtained either empirically or analytically for maximizing the diffusion of the first fluid 12 through the slot 20 and for reducing the film blowing ratio while improving film coverage and film cooling effectiveness all while using the minimum required amount of the first fluid 12 for improving the overall performance efficiency of the gas turbine engine.

Figure 5:
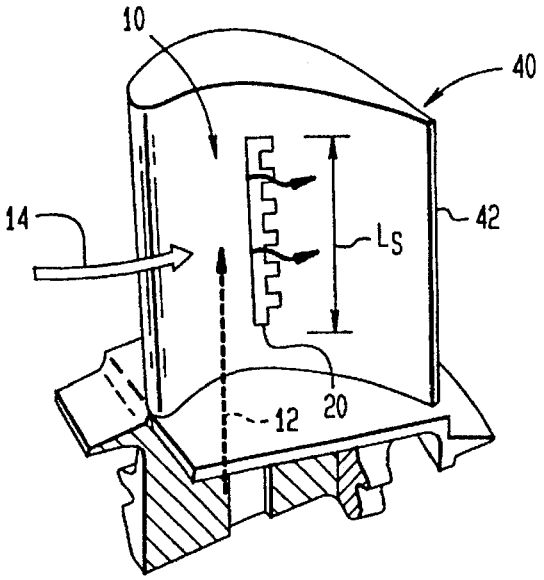
FIG. 5 is one embodiment of the wall of the present invention disposed in an airfoil of a gas turbine engine rotor blade.

The wall 10 described above may be adapted for use in a conventional gas turbine engine wherever suitable for providing improved film cooling. For example, FIG. 5 illustrates an otherwise conventional gas turbine engine turbine rotor blade 40 conventionally joinable to a disk (not shown) and over which the second fluid 14, in the form of combustion gases, flows for rotating the disk for generating shaft power. The blade 40 includes a conventional airfoil 42 having conventional pressure and suction sides, and the wall 10 forms the pressure side of the airfoil 42 in this exemplary embodiment. The slot 20 extends longitudinally in a conventional radial direction of the blade 40 and perpendicularly to the flow of the second fluid 14 which flows generally axially over the wall 10. The slot 20 faces outwardly from the wall 10, and the holes 26 (see FIG. 1) face inwardly into the airfoil 42. The airfoil 42 is conventionally hollow for channelling therethrough in a conventional manner the first fluid 12 which is a portion of compressor air for flow into the holes 26 and in turn through the slot 20 to film cool the airfoil 42 from heating by the second fluid 14, or combustion gases, flowable thereover.

Figure 6:
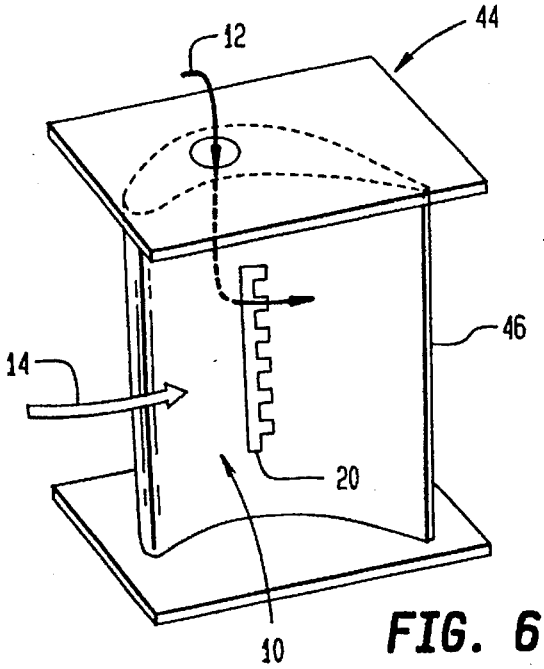
FIG. 6 is another embodiment of the wall of the present invention disposed in an airfoil of a gas turbine engine stator vane.

Similarly, FIG. 6 illustrates schematically an otherwise conventional gas turbine engine stator vane 44 having a hollow airfoil 46 through which is conventionally channeled the first fluid 12 and over which is channeled the second fluid 14. The wall 10 similarly forms the concave side of the airfoil 46 in this exemplary embodiment, and the slot 20 thereof also extends radially upwardly for providing film cooling of the airfoil 46 from heating by the second fluid 14 flowable thereover.

Figure 7:
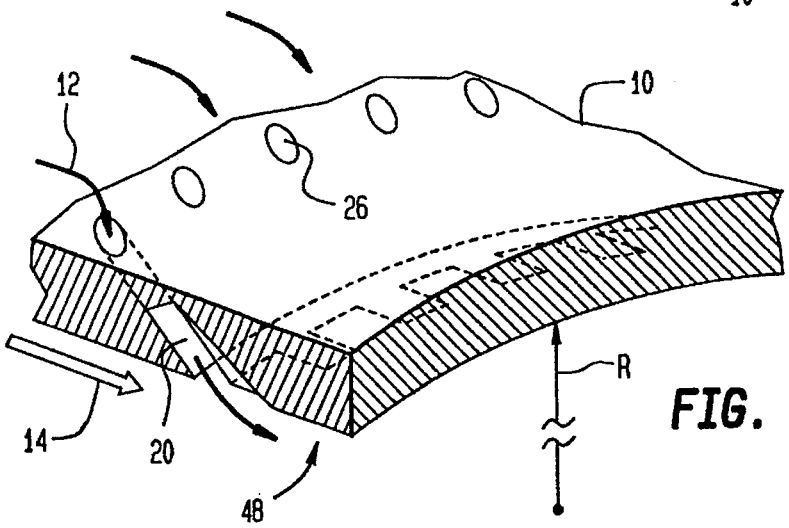
FIG. 7 is another embodiment of the wall of the present invention in the form of a liner for a gas turbine engine combustor or exhaust nozzle.

FIG. 7 illustrates another embodiment of the wall 10 which is a portion of a flat or annular (radius R) liner 48 of a combustor or exhaust nozzle which confines combustion gases such as the second fluid 14. The slot 20 in this embodiment faces radially inwardly toward the second fluid 14 and extends circumferentially around the liner 48 about the axial centerline axis thereof and perpendicularly to the flow of the second fluid 14 axially inside the liner 48. The holes 26 face radially outwardly and are spaced circumferentially around the liner 48 for receiving the first fluid 12 from outside the liner 48. In this way, more effective film cooling of the liner 48 may be provided. And, as typically found in combustion liners, axially spaced apart rows of the slots 20 and cooperating holes 26 may be provided for re-energizing the film cooling layer for the entire axial extent of the liner 48.

The wall 10 as described above may be used for other components in a gas turbine engine wherever film cooling is desired. The holes 26, slot 20, and grooves 36 provide a new arrangement for providing improved film cooling of the wall 10 in any suitable component.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims.

We claim:

1. A wall adaptable for use in a gas turbine engine between a first fluid and a second fluid being hotter than said first fluid, comprising:

a first side over which is flowable said first fluid;

an opposite second side spaced from said first side along a transverse axis and over which is flowable said second fluid in a downstream direction along an axial axis disposed perpendicularly to said transverse axis;

an elongate slot extending partly inwardly along said transverse axis from said second side toward said first side and longitudinally along a longitudinal axis disposed perpendicularly to both said transverse axis and said axial axis;

a plurality of longitudinally spaced apart metering holes extending partly inwardly from said first side toward said second side, and disposed in flow communication with said slot for channeling thereto said first fluid; and said holes being inclined along centerlines thereof at a compound angle relative to said second side for discharging said first fluid obliquely into said slot and at a shallow first discharge angle from said slot along said second side into said second fluid for film cooling said wall second side.

2. A wall according to claim 1 wherein said slot is defined by a forward surface and an aft surface spaced axially downstream therefrom, and said aft surface includes a plurality of longitudinally spaced apart grooves extending from said holes to said wall second side.

3. A wall according to claim 2 wherein said grooves are disposed perpendicularly to said slot longitudinal axis, and obliquely to said holes.

4. A wall according to claim 3 wherein said grooves taper in depth in said aft surface from a zero value adjacent said holes to a maximum value at said wall second side.

5. A wall according to claim 4 wherein:

said slot aft surface is disposed at said first discharge angle relative to said wall second side at said slot; and each of said grooves has a flat base disposed at a second discharge angle shallower than said first discharge angle.

6. A wall according to claim 5 wherein said first and second sides are generally parallel to each other.

7. A wall according to claim 5 wherein said grooves are generally square in transverse section.

8. A wall according to claim 5 wherein said grooves are generally V-shaped in transverse section.

9. A wall according to claim 5 wherein:

said wall is a portion of a gas turbine engine airfoil;

said slot extends in a radial direction perpendicularly to flow of said second fluid over said wall and faces outwardly, with said holes facing inwardly into said airfoil; and said airfoil is hollow for channeling therethrough said first fluid into said holes for flow through said slot to film cool said airfoil from heating by said second fluid flowable thereover.

10. A wall according to claim 5 wherein:

said wall is a portion of an annular gas turbine engine liner;

said slot faces radial inwardly and extends circumferentially around said liner and perpendicularly to flow of said second fluid axially inside said liner; and said holes face radially outwardly and are spaced circumferentially around said liner for receiving said first fluid from outside said liner.

* * * * *